US006651792B1

(12) United States Patent
Kuwayama

(10) Patent No.: US 6,651,792 B1
(45) Date of Patent: Nov. 25, 2003

(54) SUITCASE STRUCTURE

(75) Inventor: Osamu Kuwayama, Aichi-ken (JP)

(73) Assignee: Sunco Luggage Co., Ltd., Aichi-Ken (JP)

( * ) Notice: Subject to any disclaimer, the term of this patent is extended or adjusted under 35 U.S.C. 154(b) by 0 days.

(21) Appl. No.: 10/187,046

(22) Filed: Jul. 2, 2002

(51) Int. Cl.[7] ..... A45C 5/14; A45C 13/36

(52) U.S. Cl. ..... 190/24; 190/18 A; 190/39; 190/115; 190/122; 190/127

(58) Field of Search ..... 190/18 A, 24, 190/122, 127, 124, 115, 39, 119

(56) References Cited

U.S. PATENT DOCUMENTS 4,610,333 A * 9/1986 Seynhaeve ..... 190/18 A
4,762,211 A * 8/1988 Krenzel ..... 190/122
5,529,156 A * 6/1996 Yang ..... 190/122
5,588,569 A * 12/1996 Mitomi et al. ..... 190/18 A X
6,119,835 A * 9/2000 Lin ..... 190/127
6,148,973 A * 11/2000 Chang ..... 190/127
6,220,412 B1 * 4/2001 Lin ..... 190/127
6,260,680 B1 * 7/2001 Lin ..... 190/127 X
6,443,274 B1 * 9/2002 Klamm ..... 190/18 A

FOREIGN PATENT DOCUMENTS

GB 2024612 * 1/1980 ..... 190/127

* cited by examiner

*Primary Examiner*—Sue A. Weaver
(74) *Attorney, Agent, or Firm*—Harrison & Egber

(57) ABSTRACT

A suitcase structure includes a shell which is reinforced by a reinforcing frame. The reinforcing frame is formed of a bottom tray, a top plate, a back plate, and two side plates. The top plate and the back plate are made integrally. The bottom tray is formed of a bottom rib, a plurality of peripheral ribs raised from the fringes of the bottom rib, and a plurality of reinforcing ribs for reinforcing corners of the peripheral ribs.

1 Claim, 5 Drawing Sheets

SUITCASE STRUCTURE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a suitcase, and more particularly to a reinforced shell of the suitcase.

BACKGROUND OF THE INVENTION

It is readily important that the shell of a suitcase must be strong in structure and light in weight. In order to enhance the structural strength of the conventional suitcase shell, the shell is provided with a reinforcing frame 50, as shown in FIG. 7. The reinforcing frame 50 of the prior art is made of a rigid plastic sheet by bending. The reinforcing frame 50 has a bottom portion 50*a* which is reinforced by a bottom plate 51. The addition of the bottom plate 51 results in an increase in thickness and weight of the bottom portion 50*a* of the reinforcing frame 50. However, the bottom portion 50*a* is susceptible to deformation by the weight of articles held in the interior of the suitcase in the event that the bottom portion 50*a* is devoid of the bottom plate 51. It is readily conceivable that the deformed bottom portion 50*a* can seriously undermine the overall stability of the suitcase, thereby making the suitcase vulnerable to overturn.

BRIEF SUMMARY OF THE INVENTION

The primary objective of the present invention is to provide a suitcase shell with a reinforcing frame which is free of the shortcoming of the prior art reinforcing frame described above. Accordingly, the reinforcing frame of the present invention is devoid of the bottom plate of the prior art reinforcing frame.

In keeping with the principle of the present invention, the foregoing objective of the present invention is attained by a reinforcing frame comprising a bottom portion, a back portion, a top portion, and two side portions. The bottom portion, the back portion, the top portion, and the two side portions are all provided with means to fasten them together as an integral body. The present invention is characterized by the bottom portion, the back portion, and the top portion, which are provided with one or more reinforcing upturned flanges without increasing their thickness and weight.

The features and the advantages of the present invention will be more readily understood upon a thoughtful deliberation of the following detailed description of the present invention with reference to the accompanying drawings.

DETAILED DESCRIPTION OF THE INVENTION

As shown in FIGS. 1–4, a reinforcing frame "B1" of the first preferred embodiment of the present invention is used to construct the shell of a suitcase "A". The suitcase "A" is of a rectangular construction. The shell of the suitcase "A" is made of a cloth or plastic material. The shell of the suitcase "A" has a top portion, a bottom portion, and two side portions. The top portion is provided with a handle "C". The bottom portion is provided with a plurality of wheels "D". The back portion is provided with an expandable pull rod "E". The front portion of the suitcase "A" is provided with a cover "F" of the magic zipper. The cover "F" is provided with a small metal ring "G".

The reinforcing frame "B1" of the present invention is made of a rigid plastic material and is formed of a bottom tray 1, a back plate 2, a top plate 3, a left side plate 4, and a right side plate 4.

The bottom tray 1 is made by injection molding and is formed of a bottom ribbed surface 1*b* and a plurality of peripheral upturned flanges la which are raised from the periphery of the bottom ribbed surface 1*b*. The peripheral upturned flanges 1*a* are provided at corner with a reinforcement rib 1*c*.

The bottom tray 1 is provided in the underside with two wheel frames "D".

The back plate 2 is fastened at the lower end with the bottom tray 1.

Figure 1:
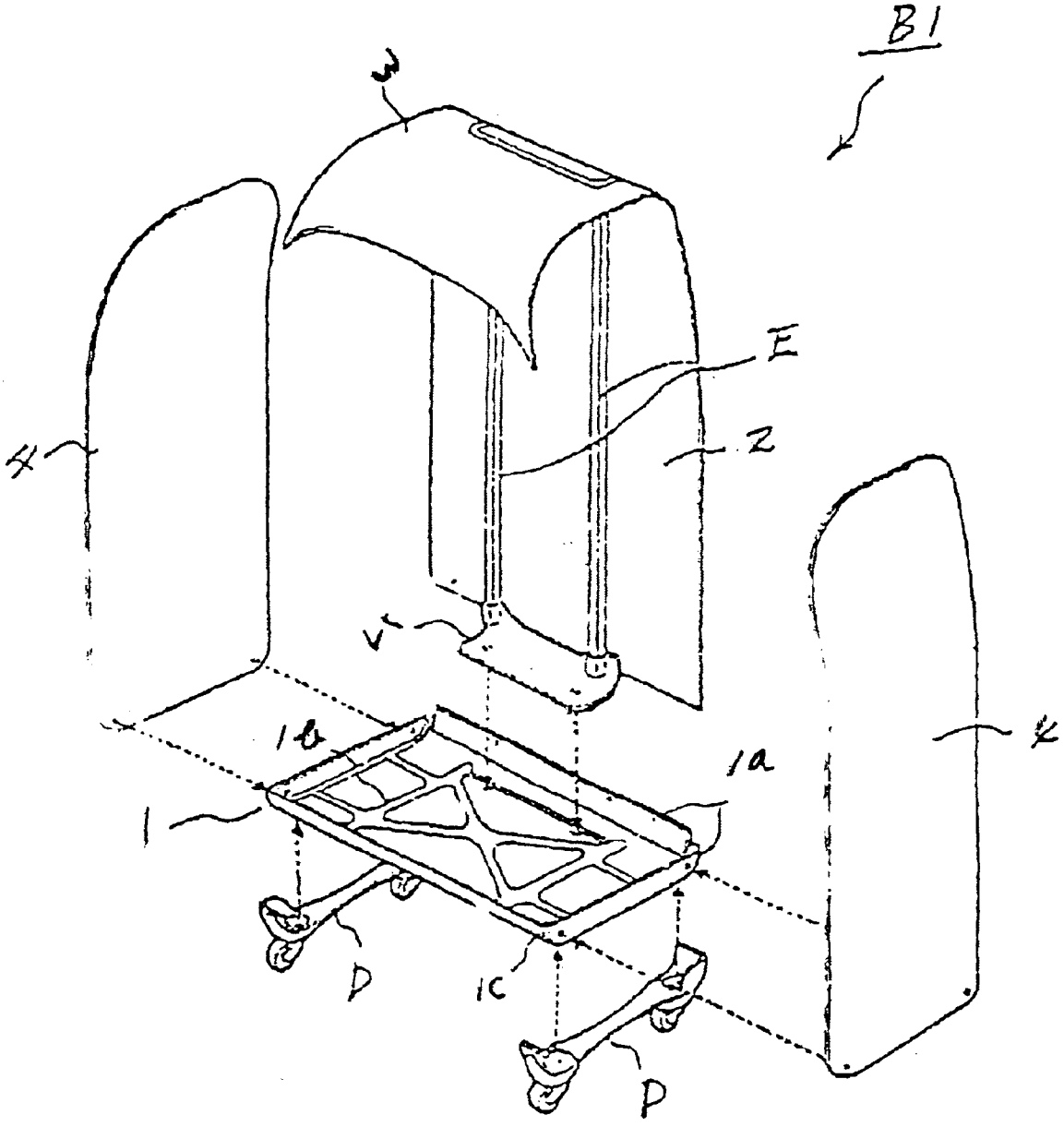
FIG. 1 shows an exploded perspective view of a reinforcing frame of a first preferred embodiment of the present invention.
Figure 2:
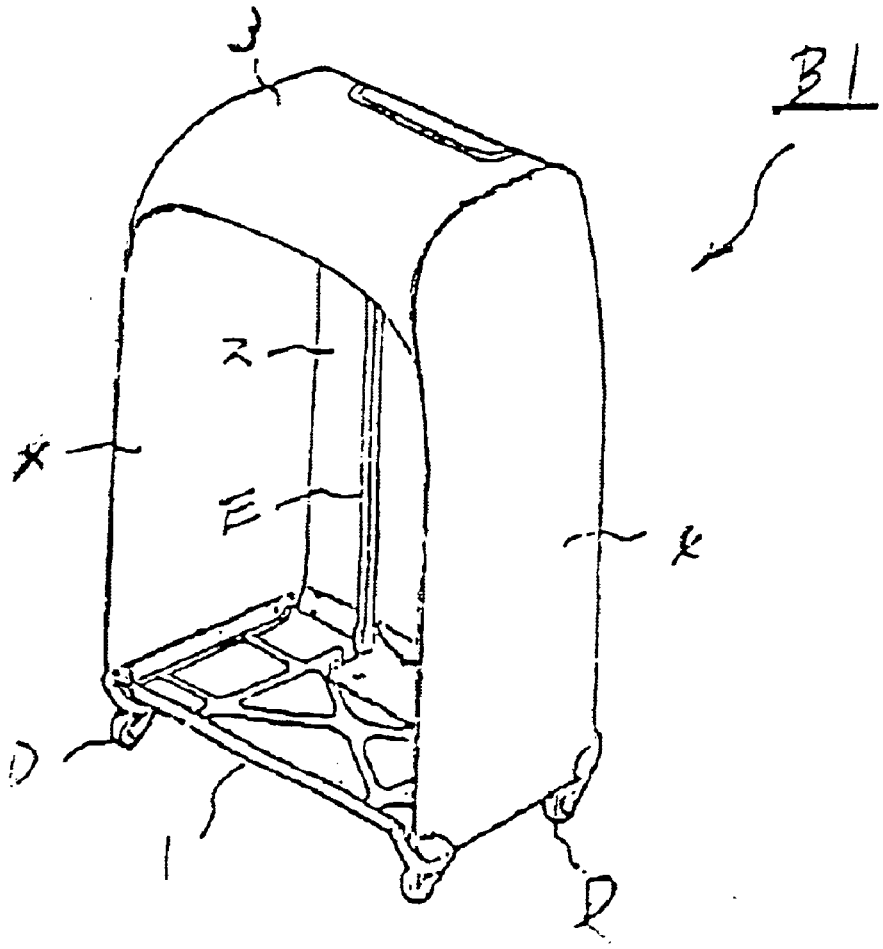
FIG. 2 shows a perspective view of the reinforcing frame of the first preferred embodiment of the present invention.
Figure 3:
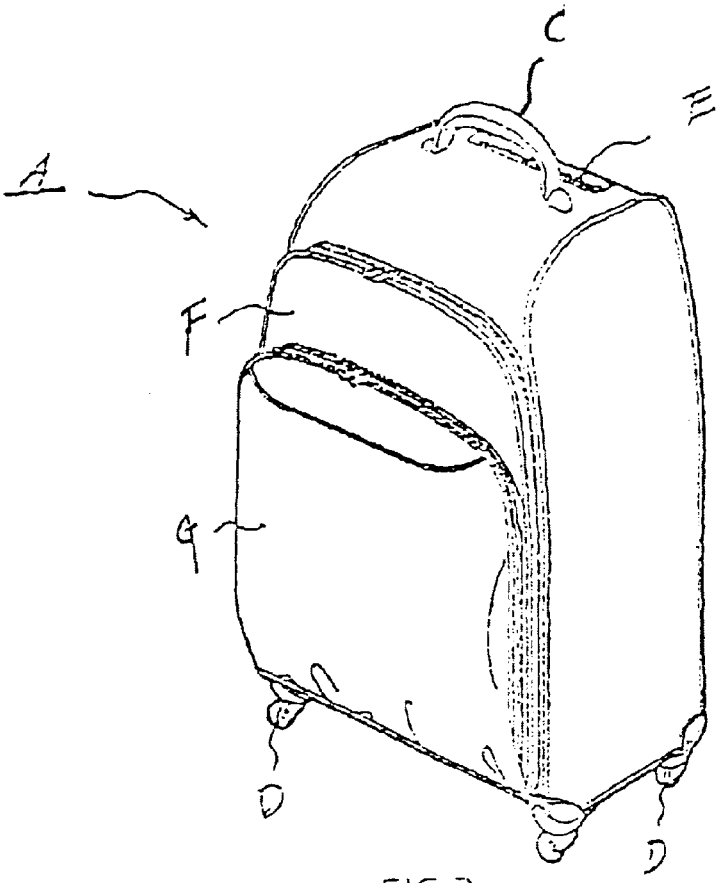
FIG. 3 shows a schematic view of the front side of a suitcase which is reinforced by the reinforcing frame of the first preferred embodiment of the present invention.
Figure 4:
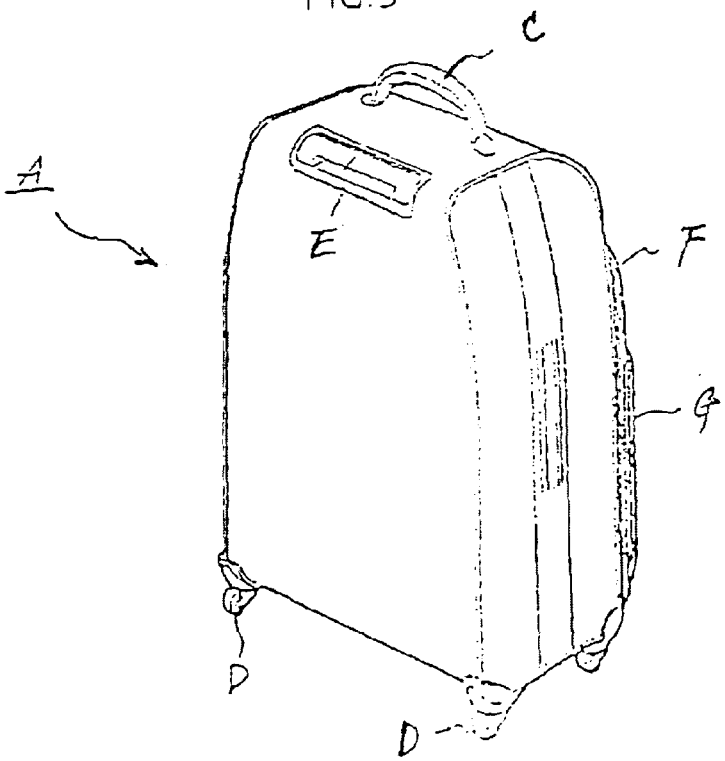
FIG. 4 shows a schematic view of the back side of the suitcase as shown in FIG. 3.

The expandable pull rod "E" is fastened at the lower end thereof with the bottom tray 1 by means of a fastening piece 5 such that the upper end of the expandable pull rod "E" is fastened with the top plate 3, as shown in FIGS. 1 and 4.

The two side plates 4 are fastened at the lower end thereof with the left side and the right side of the bottom tray 1.

The method of mounting the reinforcing frame "B1" in the suitcase "A" is not the subject matter of the present invention.

In terms of mechanics, the upturned flanges 1*a* of the bottom tray 1 of the reinforcing frame "B1" of the present invention serves to provide the suitcase "A" with the most effective reinforcing strength. In addition, the bottom ribbed surface 1*b* and the corner reinforcements 1*c* serve to enhance the structural strength of the bottom tray 1.

It must be noted here that the top plate 3 and the back plate 2 of the reinforcing frame "B1" of the first preferred embodiment of the present invention are made integrally, as shown in FIG. 1.

Figure 5:
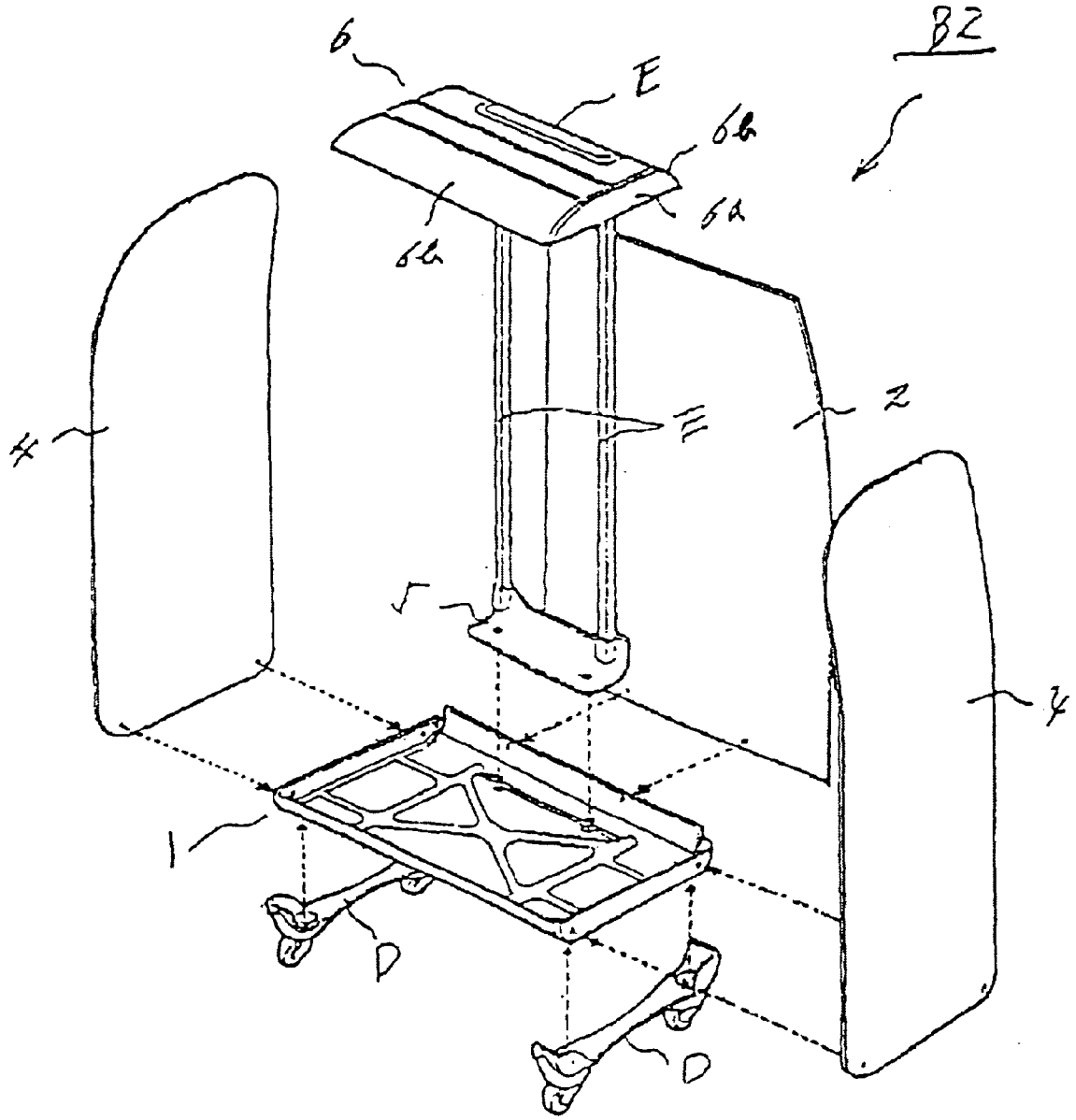
FIG. 5 shows an exploded perspective view of a reinforcing frame of a second preferred embodiment of the present invention.
Figure 6:
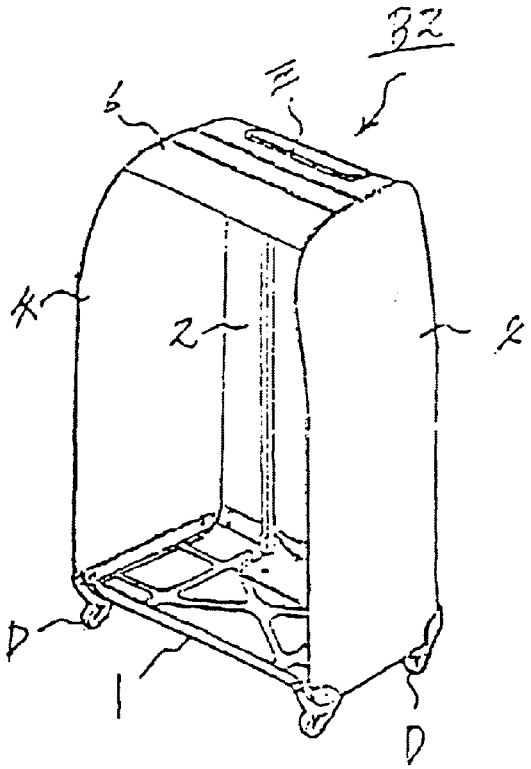
FIG. 6 shows a perspective view of the reinforcing frame of the second preferred embodiment of the present invention.
Figure 7:
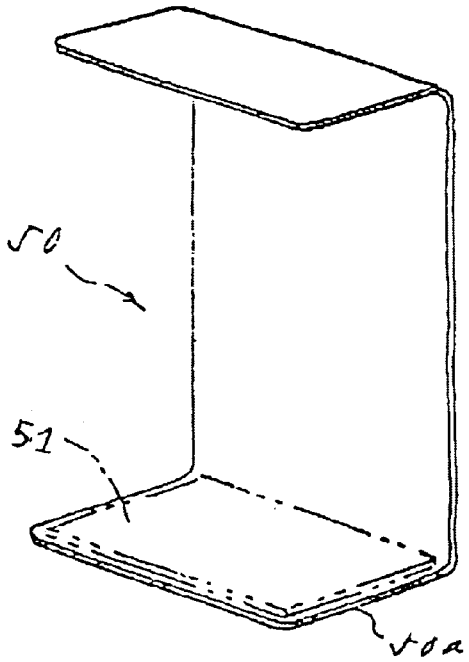
FIG.7 PRIOR ART
FIG. 7 shows a perspective view of a reinforcing frame of the prior art.

As shown in FIGS. 5 and 6, a reinforcing frame "B2" of the second preferred embodiment of the present invention is basically similar in construction to that of the first preferred embodiment of the present invention, except that the former comprises a top plate 6 which is made separately with the back plate 2 and is provided with two reinforcing downturned flanges 6*a* facing downwards, and two curved portions 6*b* curving downwards. In light of the top plate 6 being reinforced by the reinforcing downturned flanges 6*a* and the two curved portions 6*b*, the back plate 2 may be reduced in thickness. Furthermore, the reinforcing frame "B2" may be even devoid of the two side plates 4. The separation of the back plate 2 from the top plate 6 allows a greater design feasibility of the suitcase.

The embodiments of the present invention described above are to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A suitcase assembly comprising:

a shell defined by a reinforcing frame;

a handle fastened to a top portion of said shell;

an expandable pull rod assembly fastened to said reinforecing frame so as to extend vertically upwardly along an inside surface of a back portion of said shell, said expandable pull rod assembly having a fastening piece at a bottom thereof; and a plurality of wheel frames connected to said reinforcing frame at an underside of a bottom portion of said shell, said plurality of wheel frames respectively rotatably supporting a plurality of wheels therein, said reinforcing frame comprising:

a bottom tray having a ribbed surface thereon, said fastening piece of said expandable pull rod assembly affixed to said ribbed surface of said bottom tray, said bottom tray having a plurality of upturned flanges formed around a periphery thereof;

a back plate having a bottom edge affixed to an exterior surface of the upturned flanges at a back of said bottom tray;

a top plate integrally formed within said back plate; and a pair of side plates each having a bottom edge affixed to an exterior surface of the upturned flange at a respective side of said bottom tray, each of said pair of side plates having a top edge affixed to a respective side of said top plate, each of said pair of side plates having an edge secured to a respective side of said back plate.

* * * * *